US009680240B2

(12) United States Patent
Burris et al.

(10) Patent No.: US 9,680,240 B2
(45) Date of Patent: Jun. 13, 2017

(54) CONNECTORS INCLUDING APERTURES FOR GROUNDING OUTER CONDUCTORS OF CONDUITS AND CONNECTORS INCLUDING GROUNDING GROOVES FOR GROUNDING OUTER CONDUCTORS OF CONDUITS

(71) Applicant: Corning Optical Communications RF LLC, Glendale, AZ (US)

(72) Inventors: Donald Andrew Burris, Peoria, AZ (US); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/923,480

(22) Filed: Oct. 27, 2015

(65) Prior Publication Data

US 2016/0118748 A1 Apr. 28, 2016

Related U.S. Application Data

(60) Provisional application No. 62/069,547, filed on Oct. 28, 2014.

(51) Int. Cl.
*H01R 9/05* (2006.01)
*H01R 4/64* (2006.01)
(Continued)

(52) U.S. Cl.
CPC ..... *H01R 4/646* (2013.01); *H01R 4/34* (2013.01); *H01R 4/36* (2013.01); *H01R 4/643* (2013.01)

(58) Field of Classification Search
CPC ..... H01R 4/646
(Continued)

(56) References Cited

U.S. PATENT DOCUMENTS 3,832,672 A 8/1974 Loos
3,967,872 A * 7/1976 Mooney ..... H01R 4/64 174/78
(Continued)

OTHER PUBLICATIONS

Crescent Electric Supply Company, Steel City BG-804 Insulated Grounding Bushing; 1-1/4 Inch, Threaded × Screw, Malleable Iron, downloaded from internet on Feb. 24, 2014, 2 pages.
(Continued)

*Primary Examiner* — Tulsidas C Patel
*Assistant Examiner* — Peter G Leigh

(57) ABSTRACT

Connectors including apertures for grounding outer conductors of conduits and connectors including grounding grooves for grounding outer conductors of conduits are disclosed. In some embodiments, a connector includes a bore, a gripping portion axially surrounding the bore, a generally cylindrical aperture for receiving a grounding wire, and a securing port for securing the grounding wire in the aperture. An exterior gripping surface of the gripping portion is symmetric. The generally cylindrical aperture extends along an aperture centerline through at least a portion of the gripping portion. The securing port extends along a securing port centerline and intersects the generally cylindrical aperture. In other embodiments, a connector includes a grounding groove extending at least partially around an outer diameter of the connector that is adapted to receive the grounding wire, and a securing port longitudinally offset from the grounding groove and extending along a securing port centerline.

7 Claims, 6 Drawing Sheets

(51) Int. Cl.
*H01R 4/34* (2006.01)
*H01R 4/36* (2006.01)

(58) Field of Classification Search
USPC ..... 439/578, 95, 98, 100
See application file for complete search history.

(56) References Cited

U.S. PATENT DOCUMENTS 4,210,374 A * 7/1980 Churla ..... H01R 4/60 285/404
4,623,205 A 11/1986 Barron
4,806,108 A * 2/1989 Meinhardt ..... H01R 4/64 439/100
4,976,627 A * 12/1990 O'Loughlin ..... H02G 3/285 174/71 R
5,460,532 A * 10/1995 Leto ..... H01R 4/643 285/404
5,929,383 A * 7/1999 Marik ..... H01R 13/648 174/78
7,165,980 B2 * 1/2007 Pyron ..... H01R 4/643 439/100
7,281,932 B2 * 10/2007 Cheng ..... H02G 3/0616 439/100
7,537,467 B1 * 5/2009 Gretz ..... H01R 4/36 439/108
7,758,356 B2 * 7/2010 Burris ..... H01R 4/646 439/578
8,231,392 B2 * 7/2012 Garvin ..... H01R 4/643 439/100
8,277,263 B1 * 10/2012 Smith ..... H01R 4/32 439/779
8,487,197 B2 * 7/2013 Smith ..... H02G 3/0616 174/552
8,512,052 B2 * 8/2013 Garvin ..... H01R 4/643 439/100
8,882,517 B2 * 11/2014 Smith ..... H01R 4/64 439/92
8,899,998 B2 * 12/2014 Pyron ..... H01R 4/30 439/100
9,257,795 B2 * 2/2016 Smith ..... H01R 13/655
9,350,154 B2 * 5/2016 Dinh ..... H02G 15/04
9,385,442 B2 * 7/2016 Brown ..... H02G 3/22
2010/0203748 A1 * 8/2010 Wason ..... H01R 9/2483 439/98

OTHER PUBLICATIONS

TVC Communications Product Showcase, TVC Brand Ground Block and F-81 Splice, downloaded from internet on Feb. 24, 2014, 1 page.
TVC Communications Product Showcase, SC12-4W Four Way Grounding Block, downloaded from internet on Feb. 24, 2014, 1 page.
TVC Section 8: Drop Materials Grounding Materials, downloaded from internet on Feb. 24, 2014, 11 pages.
New Tech Industries, Inc., CATV Grounding Blocks—Galvanized Ground Straps Grounding Rods—Grounding Wire—Direction Finding Compass, downloaded from internet on Feb. 24, 2014, 5 pages.
Gilbert Engineering Co., Inc., Pedestal Splice Block w/ Ground Lug, Dwg. No. NS-10722, Jul. 2002, 1 page.

* cited by examiner

CONNECTORS INCLUDING APERTURES FOR GROUNDING OUTER CONDUCTORS OF CONDUITS AND CONNECTORS INCLUDING GROUNDING GROOVES FOR GROUNDING OUTER CONDUCTORS OF CONDUITS

PRIORITY APPLICATION

This application claims the benefit of priority under 35 U.S.C. §119 of U.S. Provisional Application Ser. No. 62/069,547 filed on Oct. 28, 2014 the content of which is relied upon and incorporated herein by reference in its entirety.

BACKGROUND

Field

The present disclosure generally relates to connectors and, more particularly, to connectors including apertures for grounding outer conductors of conduits and connectors including grounding grooves for grounding outer conductors of conduits.

Technical Background

It may be desirable to ground an outer conductor of a conduit in certain types of conduit applications. For example, many types of conduits, such as electric conduits, fiber optic feed-through conduits, hydraulic conduits, coaxial cables, and the like include outer conductors. It may be desirable to ground the outer conductor of such conduits to an electrical ground to conduct transient voltages from lightning strikes, static electricity, or the like, from the outer conductor to the ground, thereby avoiding damage to the conduit system.

Accordingly, a need exists for connectors for grounding outer conductors of conduits.

SUMMARY

In one embodiment, a connector is adapted to receive a conduit having an outer conductor and for grounding the outer conductor of the conduit with a grounding wire. The connector includes a bore, a gripping portion, a generally cylindrical aperture, and a securing port. The bore extends longitudinally along a bore centerline and is adapted to receive the conduit. The gripping portion axially surrounds the bore and extends longitudinally along a length along the bore centerline. The gripping portion is defined along the length between an interior bore-defining surface and an exterior gripping surface. In a cross-section of the gripping portion taken perpendicular to the bore centerline, the exterior gripping surface is symmetric about a first plane parallel to the bore centerline. In the cross-section, the exterior gripping surface is symmetric about a second plane parallel to the bore centerline and perpendicular to the first plane. The generally cylindrical aperture extends along an aperture centerline through at least a portion of the gripping portion. The generally cylindrical aperture is adapted to receive the grounding wire. The securing portion extends along a securing port centerline and intersects the generally cylindrical aperture. The securing port is adapted to receive a securing member for securing the grounding wire within the generally cylindrical aperture.

In another embodiment, a connector is adapted to receive a conduit having an outer conductor and for grounding the outer conductor of the conduit with a grounding wire. The connector includes a bore, a gripping portion, a generally cylindrical through hole, and a securing port. The bore extends longitudinally along a bore centerline and is adapted to receive the conduit. The gripping portion axially surrounds the bore and extends longitudinally along a length along the bore centerline. The gripping portion is defined along the length between an interior bore-defining surface and an exterior gripping surface. The generally cylindrical through hole extends along a through hole centerline through the gripping portion from a generally circular entry location to a generally circular exit location. The through hole centerline is transverse to the bore centerline. The generally cylindrical through hole is adapted to receive the grounding wire. The securing port extends along a securing port centerline and intersects the generally cylindrical through hole. The securing port centerline is offset from and parallel to the bore centerline. The securing port is adapted to receive a securing member for securing the grounding wire within the generally cylindrical through hole.

In yet another embodiment, a connector is adapted to receive a conduit having an outer conductor and for grounding the outer conductor of the conduit with a grounding wire. The connector includes a bore, a gripping portion, an aperture, and a securing port. The bore extends longitudinally along a bore centerline and is adapted to receive the conduit. The gripping portion axially surrounds the bore and extends longitudinally along a length along the bore centerline. The gripping portion is defined along the length between an interior bore-defining surface and an exterior gripping surface. The aperture includes a first aperture portion and a second aperture portion. The first aperture portion extends along a first aperture centerline through the gripping portion. The second aperture portion extends along a second aperture centerline through the gripping portion. The first aperture centerline intersects the second aperture centerline. The first aperture portion and the second aperture portion are adapted to receive the grounding wire. The securing port extends along a securing port centerline and intersects the aperture. The securing port is adapted to receive a securing member for securing the grounding wire within the aperture.

In yet another embodiment, a connector is adapted to receive a conduit having an outer conductor and for grounding the outer conductor of the conduit with a grounding wire. The connector includes a bore, a grounding groove, and a securing port. The bore extends longitudinally along a bore centerline and is adapted to receive the conduit. The grounding groove extends at least partially around an outer diameter of the connector. The grounding groove is adapted to receive the grounding wire such that the grounding wire extends transverse to the bore centerline when the grounding groove receives the grounding wire. The securing port is longitudinally offset from the grounding groove and extends along a securing port centerline. The securing port centerline is transverse to the bore centerline. The securing port is adapted to receive a securing member for securing the grounding wire within the grounding groove.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

DETAILED DESCRIPTION

Embodiments of the present disclosure are directed to connectors including apertures for grounding outer conductors of conduits and connectors including grounding grooves for grounding outer conductors of conduits. Some embodiments of connectors disclosed herein include a bore extending longitudinally along a bore centerline and adapted to receive the conduit, a gripping portion axially surrounding the bore and extending longitudinally along the bore centerline. Some embodiments include generally cylindrical apertures extending through a gripping portion having a symmetric exterior gripping surface. Such embodiments may be easily and less expensively manufactured. Some embodiments include a generally cylindrical through hole extending transverse to the bore centerline. Such embodiments may facilitate the daisy chaining of multiple connectors to be grounded by a common grounding wire. Some embodiments include grounding grooves formed through an external surface of the connector, and may provide an easy and convenient way to ground a conduit electrically coupled to the connector via a grounding wire in engagement with the grounding groove. The connectors described herein may be more compact, require fewer parts, and require less mounting space than conventional grounding connectors. Various connectors including apertures for grounding outer conductors of conduits and connectors including grounding grooves for grounding outer conductors of conduits are described in detail below.

Figure 1:
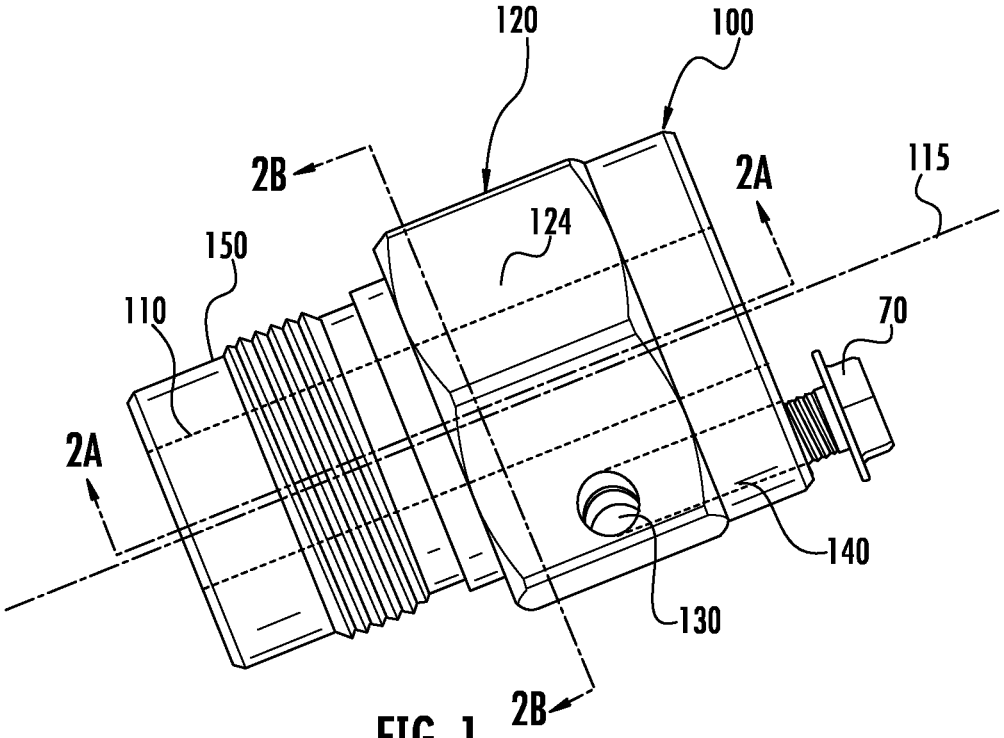
FIG. 1 schematically depicts a perspective view of a connector including an aperture extending through a gripping portion of the connector transverse to a centerline of a bore, according to one or more embodiments shown and described herein.
Figure 2A:
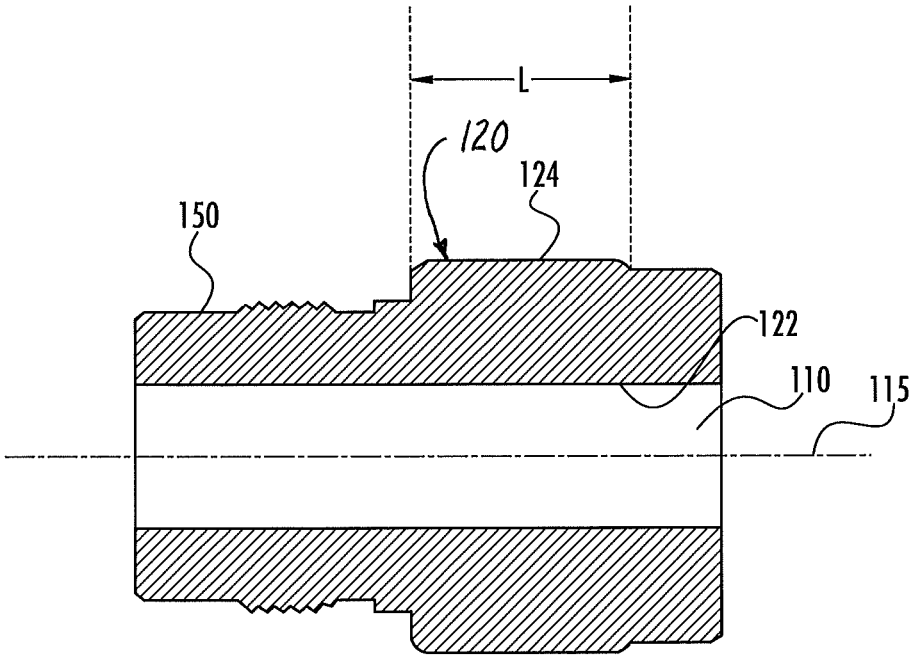
FIG. 2A schematically depicts a cross sectional view of the connector of FIG. 1 taken along the 2A-2A line of FIG. 1, according to one or more embodiments shown and described herein.
Figure 2B:
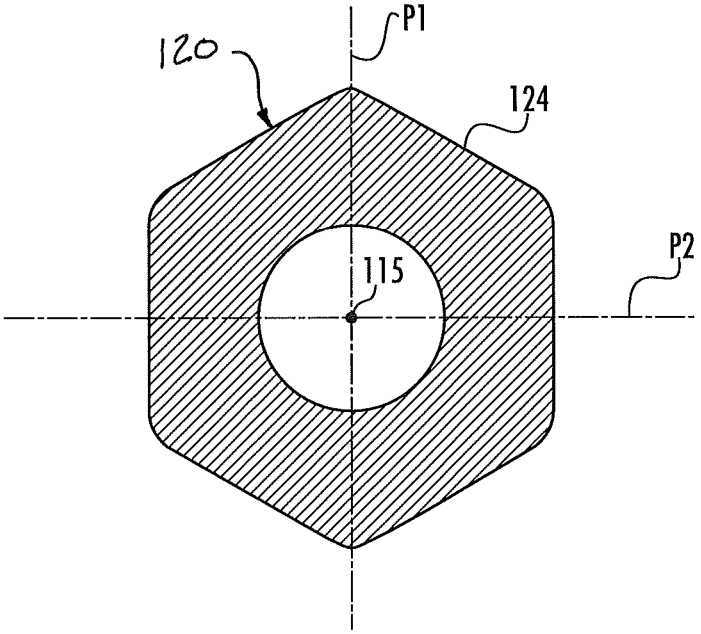
FIG. 2B schematically depicts a cross sectional view of the connector of FIG. 1 taken along the 2B-2B line of FIG. 1, according to one or more embodiments shown and described herein.
Figure 3:
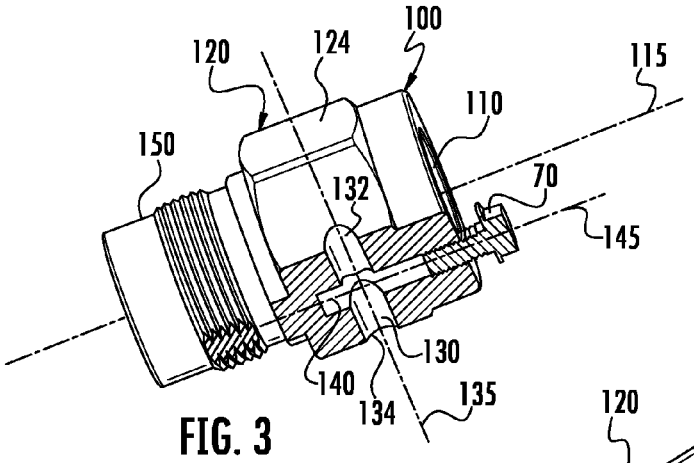
FIG. 3 schematically depicts a perspective partial cross sectional view of the connector of FIG. 1, according to one or more embodiments shown and described herein.

Referring now to FIGS. 1-3, a connector 100 is schematically depicted. The connector 100 is adapted to receive a conduit (e.g., a coaxial cable, a fiber optical feed through conduit, a hydraulic conduit, an electrical conduit, or the like) having an outer conductor and to ground the outer conductor of the conduit with a grounding wire, as will be described in detail below.

Still referring to FIGS. 1-3, the connector 100 includes a bore 110, a gripping portion 120, an aperture 130, a securing port 140, and a coupling portion 150. The bore 110 extends longitudinally along a bore centerline 115 and is adapted to receive the conduit.

The gripping portion 120 axially surrounds the bore 110. As shown in FIG. 2A (depicting a longitudinal cross-section of the connector 100 taken along the 2A-2A line of FIG. 1), the gripping portion 120 extends longitudinally along a length L along the bore centerline 115 and is defined along the length L between an interior bore-defining surface 122 and an exterior gripping surface 124. The exterior gripping surface 124 may facilitate gripping of the connector 100 by a tool or a user's hand to manipulate or grip the connector such as when the exterior gripping surface 124 is engaged by a wrench to rotate or secure the connector 100 when coupling the connector 100 to another component. Referring once again to FIG. 1, the exterior gripping surface 124 includes a plurality of external features extending around the exterior gripping surface. In the embodiment depicted in FIG. 1, the external features are six regular and repeated planar surfaces forming a hexagonal gripping surface, which may facilitate the gripping of the exterior gripping surface 124 by a tool (e.g., a wrench) or user's hand for manipulation of the connector 100. While the external features of FIG. 1 are planar surfaces, other embodiments may include knurls as the external features. While the external surfaces of FIG. 1 are regular and repeated, in other embodiments, the external surfaces may not be regular or repeated, such as in embodiments in which the external features are not symmetric around the exterior gripping surface 124. In some embodiments, the exterior gripping surface 124 does not include a plurality of external features, such as when the exterior gripping surface 124 is a generally smooth cylinder.

Still referring to the gripping portion 120, as shown in FIG. 2B (depicting a cross-section of the connector 100 taken perpendicular to the bore centerline 115 along the 2B-2B line of FIG. 1), the exterior gripping surface 124 is symmetric about a first plane P1. The first plane P1 extends parallel to the bore centerline 115. The exterior gripping surface 124 is also symmetric about a second plane P2. The second plane P2 extends parallel to the bore centerline 115 and perpendicular to the first plane P1. A connector 100 with an exterior gripping surface 124 that is symmetric about both the first plane P1 and the second plane P2, as shown in FIGS. 1-3, may allow the connector 100 to be uniformly gripped and manipulated along any portion of the exterior gripping surface 124, which may provide for easier manipulation of the connector than an embodiment in which a grounding lug or other protrusion extended from the connector 100. Furthermore, a connector 100 with an exterior gripping surface 124 that is symmetric about both the first plane P1 and the second plane P2 may be easier and less expensive to manufacture than a connector including a grounding lug or protrusion extending from the gripping portion 120. However, it should be understood that other embodiments may not include an exterior gripping surface 124 that is symmetric about the first plane P1 or the second plane P2.

Referring now to FIG. 3, the aperture 130 extends along an aperture centerline 135 through the gripping portion 120. The aperture 130 is adapted to receive a grounding wire for grounding the connector 100, as will be described below. While the aperture 130 extends through an entire transverse thickness of the gripping portion 120 in the embodiment depicted in FIG. 3, it should be understood that in other embodiments the aperture 130 may only extend partially through a transverse thickness of the gripping portion 120. The aperture 130 is generally cylindrical, which may allow for the aperture 130 to securely and snugly receive a generally cylindrical grounding wire. However, other embodiments may include an aperture that is not generally cylindrical, such as embodiments in which the aperture is generally rectangular, generally triangular, generally hexagonal, or the like. While the aperture 130 extends through a thickness of the gripping portion 120, in other embodiments, the aperture 130 may extend through a thickness of another portion of the connector 100, such as in embodiments in which the aperture 130 extends through a portion of the connector 100 that is longitudinally adjacent to or offset from the gripping portion 120 or in embodiments that do not include the gripping portion 120.

By forming the aperture 130 through a thickness of the gripping portion 120, as depicted in FIG. 3, the connector 100 may be more easily and less expensively manufactured than a connector including an aperture for receiving a grounding wire that is formed through a lug or protrusion axially protruding from the connector 100. For example, conventional connectors may include grounding lugs permanently attached to or projecting from a main body of the connector, which may undesirably require considerable physical space to accommodate the necessary hardware, may require additional grounding components, may limit the positioning of tools for manipulating the connectors, and may take significant time to manipulate and install. However, the connectors described herein may be more compact, require fewer parts, and require less mounting space than conventional grounding connectors.

Still referring to FIG. 3, the securing port 140 extends through the connector 100 along a securing port centerline 145 and intersects the aperture 130. The securing port 140 is adapted to receive a securing member (e.g., the securing member 70 depicted in FIG. 3) for securing the grounding wire within the aperture 130. The securing port 140 is internally threaded such that the securing port 140 is adapted to receive a threaded securing member 70 (e.g., the threaded grounding screw or set screw shown in FIG. 3) that is selectively advanceable within the securing port 140 for securing the grounding wire within the aperture 130. However, in other embodiments, the securing port 140 may not be internally threaded and the securing member 70 may not be a threaded grounding screw, such as embodiments in which the securing port 140 is not internally threaded and the securing member 70 is a press-fit pin, or the like. The securing port 140 is generally cylindrical, which may allow for the securing port 140 to securely and snugly receive a generally cylindrical securing member, such as a screw, pin, or the like. However, other embodiments may include a securing port that is not generally cylindrical, such as embodiments in which the securing port is generally rectangular, generally triangular, generally hexagonal, or the like.

Figure 6:
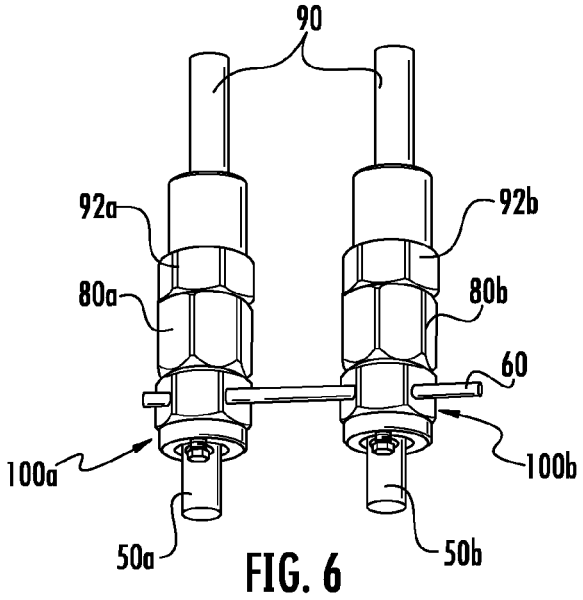
FIG. 6 schematically depicts a perspective view of two connectors coupled to conduits, coupled to hydraulic tubing, and coupled to a grounding wire, according to one or more embodiments shown and described herein.

As noted above, the aperture 130 extends through the gripping portion 120 along the aperture centerline 135, and the securing port 140 extends through the connector 100 along the securing port centerline 145. In the embodiment depicted in FIG. 3, the aperture centerline 135 is transverse to the bore centerline 115. When the aperture 130 extends along an aperture centerline 135 that is transverse to the bore centerline 115, multiple connectors 100 including such a transverse aperture may be daisy chained together such that the connectors can be grounded by a common grounding wire received in each of the apertures. For example, as shown in FIG. 6, a first connector 100*a* and a second connector 100*b*, each having the same construction as the connector 100 depicted and described above, are positioned next to one another and ground the respective outer conductors of a first conduit 50*a* and a second conduit 50*b* to a common grounding wire 60 that extends through the aperture of each of the connectors. When the outer conductors of the first conduit 50*a* and the second conduit 50*b* are grounded, a flowable medium (e.g., hydraulic fluid) may be introduced into the conduits via a hydraulic supply hose 90 terminating in a hydraulic connector 92*a* that is coupled to a hydraulic fitting 80*a*, which in turn is coupled to the connector 100. In some embodiments in which the conduits are coaxial cables, such hydraulic fluid may be introduced to separate the dielectric and inner conductor from the surrounding outer conductor so that the dielectric and inner conductor may be removed from the coaxial cable. In some embodiments the aperture centerline 135 may not be transverse to the bore centerline 115, such as embodiments in which the aperture 130 extends through the gripping portion at an angle non-perpendicular to the bore centerline 115 or in embodiments in which the aperture centerline 135 is parallel to the bore centerline 115.

Still referring to FIG. 3, the securing port centerline 145 is offset from and parallel to the bore centerline 115. The securing port centerline 145 depicted in FIG. 3 is also transverse to the aperture centerline 135. A securing port 140 having a securing port centerline 145 that is transverse to the aperture centerline 135 may allow for a securing member 70 to be inserted in the securing port 140 to snugly secure the grounding wire within the aperture 130. However, in other embodiments, the securing port centerline 145 may not be parallel to the bore centerline 115 or transverse to the aperture centerline 135 such as embodiments in which the securing port 140 extends through the connector 100 at an angle non-perpendicular to the aperture centerline 135.

Still referring to FIG. 3, the aperture 130 is a generally cylindrical through hole that extends through the gripping portion 120 from a generally circular entry location 132 to a generally circular exit location 134. An aperture that extends through the gripping portion 120 from an entry location to an exit location may facilitate the daisy chaining of multiple connectors together such that the connectors can be grounded by a common grounding wire received in each of the apertures, as shown in FIG. 6 and as described above. In some embodiments, the entry location and exit location may not be generally circular, such as embodiments in which the aperture 130 is not generally cylindrical.

Still referring to FIG. 3, the coupling portion 150 of the connector 100 is longitudinally offset from the gripping portion 120 and includes a threaded external surface for threadedly coupling the connector to a component. In some embodiments, the connector 100 may be threadedly coupled to a hydraulic fitting through which hydraulic fluid may be introduced into the bore of the connector 100 and into a conduit coupled to the connector 100.

Figure 5:
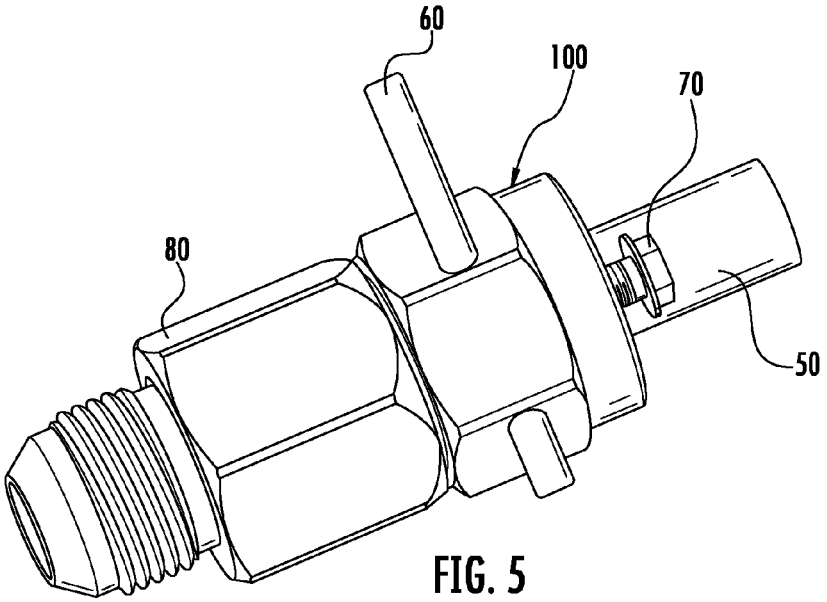
FIG. 5 schematically depicts a perspective view of the connector of FIG. 1 coupled to a conduit, coupled to a grounding wire, and coupled to a hydraulic fitting, according to one or more embodiments shown and described herein.
Figure 12:
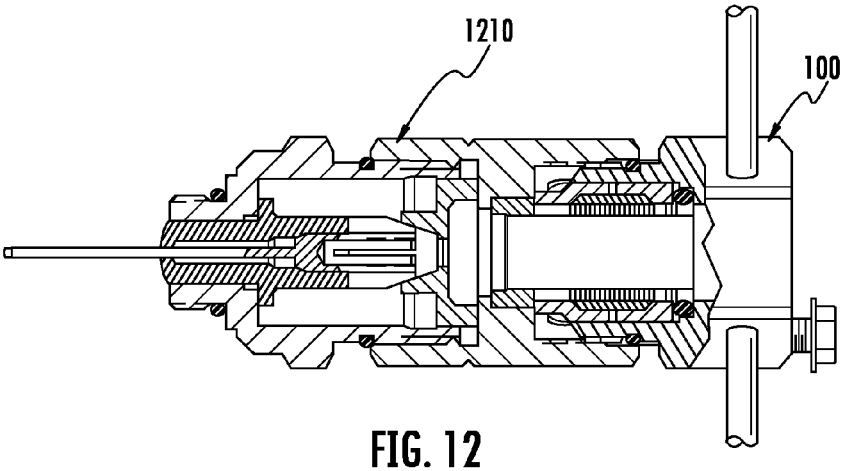
FIG. 12 schematically depicts a connector assembly including the connector of FIG. 1 and an RF coaxial connector coupled to the connector of FIG. 1, according to one or more embodiments shown and described herein.

For example, as depicted in FIG. 5, a hydraulic fitting 80 threadedly engages the threaded external surface of the coupling portion of the connector 100 such that the hydraulic fitting 80 is threadedly coupled to the connector 100. Still referring to FIG. 5, a conduit 50 is received by the other end of the connector 100. The outer conductor of the conduit 50 is secured to the connector 100 by the threadedly engaged hydraulic fitting 80. The outer conductor of the conduit 50 is grounded by the connector 100 via a grounding wire 60 that extends through an aperture of the gripping portion of the connector 100. Hydraulic fluid may then be introduced into the bore of the connector 100 through the hydraulic line so that the hydraulic fluid enters the conduit 50. In some embodiments, the conduit 50 is coaxial cable having an end prepared by stripping away the outer jacket to expose the outer conductor surrounded by the jacket. Hydraulic fluid may be introduced into the prepared end of the coaxial cable to separate the outer conductor of the coaxial cable from dielectric material surrounded by the outer conductor. In other embodiments, the conduit 50 may simply be a conduit for transmitting the hydraulic fluid through the conduit. Regardless of the type of conduit 50, it may be desirable to ground the outer conductor of the conduit 50 via the grounding wire 60 that traverses through the aperture formed in the gripping portion of the conduit in order to conduct transient voltages resulting from lightning strikes, static electricity, or the like to ground, thereby avoiding potential damage to the conduit system if such voltages were not conducted to the ground. In other embodiments, the connector 100 may be coupled (e.g. via the external threaded surface of the coupling portion 150 to components other than hydraulic fittings, such as the embodiment depicted in FIG. 12 in which the connector 100 is coupled to a standard RF connector 1210).

Figure 4:
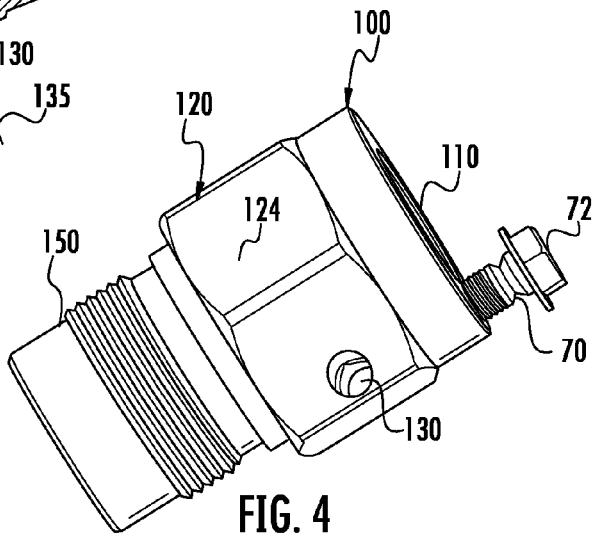
FIG. 4 schematically depicts a perspective view of the connector of FIG. 1 with a securing member having a break-away head coupled to the connector, according to one or more embodiments show and described herein.

Referring now to FIG. 4, the connector 100 of FIGS. 1-3 is schematically depicted along with a securing member 70 that includes a break-away head 72. The break-away head 72 includes a weakened, reduced diameter portion that fractures and shears off when a predetermined amount of rotational force is applied to the break-away head 72 after the bottom of the securing member 70 engages the grounding wire. This predetermined amount of force is set to be a force which ensures that the securing member 70 has been sufficiently tightened to secure the grounding wire to the connector 100. Once the break-away head 72 shears off during or after the securing member 70 is advanced to engage the grounding wire, it is more difficult to remove the base portion of the securing member 70 from the securing port, thereby deterring unauthorized persons from removing the grounding wire 60 from the securing port. Some embodiments of the securing member 70 do not include a break-away head 72, such as embodiments in which the securing member 70 includes a standard head, as depicted in the embodiment of FIG. 1.

Figure 7:
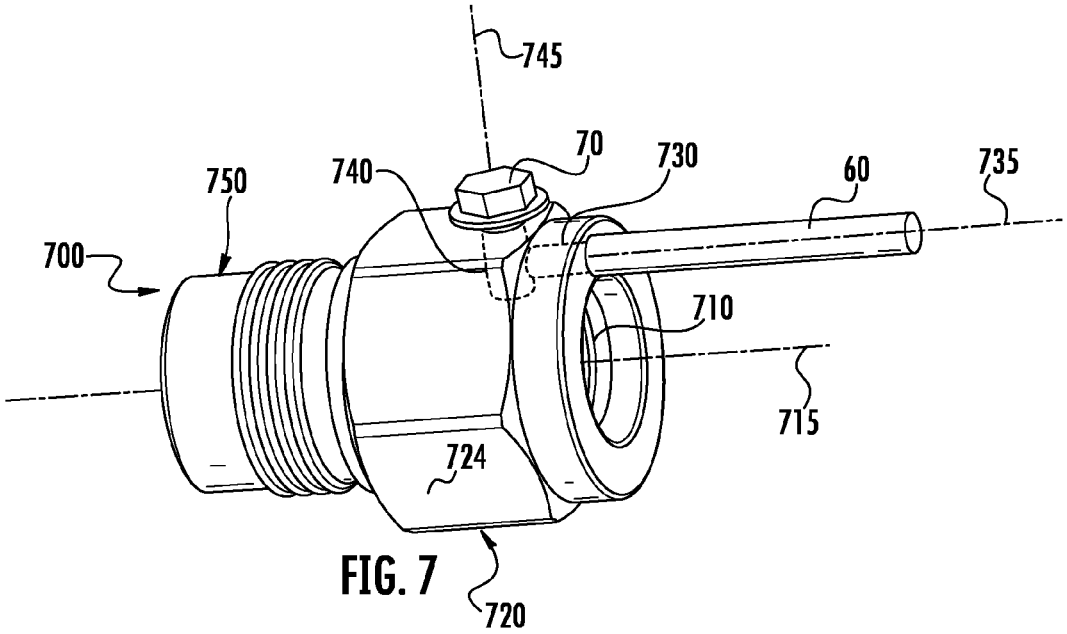
FIG. 7 schematically depicts a perspective view of a connector including an aperture extending through a gripping portion of the connector parallel to a centerline of a bore, according to one or more embodiments shown and described herein.

Referring now to FIG. 7, a connector 700 is schematically depicted. The connector 700 is adapted to receive a conduit having an outer conductor and to ground the outer conductor of the conduit with a grounding wire. The connector 700 includes a bore 710, a gripping portion 720, an aperture 730, a securing port 740, and a coupling portion 750. The bore 710 extends longitudinally along a bore centerline 715 and is adapted to receive the conduit.

The gripping portion 720 axially surrounds the bore 710 and extends longitudinally along a length along the bore centerline 715. A longitudinal cross-section of the connector 700 that does not intersect the aperture 730 or the securing port 740 is the same as the longitudinal cross-section of the connector 100 depicted in FIG. 2A. In particular, the gripping portion 720 is defined along the length between an interior bore-defining surface and an exterior gripping surface 724. The exterior gripping surface 724 may facilitate gripping of the connector 700 by a tool or a user's hand to manipulate or grip the connector such as when the exterior gripping surface 724 is engaged by a wrench to rotate or secure the connector 700 when coupling the connector 100 to another component. The exterior gripping surface 724 includes a plurality of external features extending around the exterior gripping surface. In the embodiment depicted in FIG. 7, the external features are six regular and repeated planar surfaces forming a hexagonal gripping surface, which may facilitate the gripping of the exterior gripping surface 724 by a tool (e.g., a wrench) or user's hand for manipulation of the connector 700. While the external features are planar surfaces in FIG. 7, other embodiments may include knurls as the external features. While the external surfaces of FIG. 7 are regular and repeated, in other embodiments, the external surfaces may not be regular or repeated, such as in embodiments in which the external features are not symmetric around the exterior gripping surface 724. In some embodiments, the exterior gripping surface 724 does not include a plurality of external features, such as when the exterior gripping surface 724 is a generally smooth cylinder.

As with the exterior gripping surface 124 of the connector 100 depicted and described above with respect to FIG. 2B, the exterior gripping surface 724 of the connector 700 (in a cross-section of the exterior gripping surface 724 taken perpendicular to the bore centerline at a location that does not intersect the aperture 730 or the securing port 740) is symmetric about a first plane parallel to the bore centerline and is symmetric about a second plane parallel to the bore centerline and perpendicular to the first plane. However, it should be understood that other embodiments may not include such a symmetric exterior gripping surface 724.

Still referring to FIG. 7, the aperture 730 extends along an aperture centerline 735 through the connector 700. The aperture 730 is adapted to receive a grounding wire 60 for grounding the connector 700. The aperture 730 is generally cylindrical, which may allow for the aperture 730 to securely and snugly receive a generally cylindrical grounding wire, such as the generally cylindrical grounding wire 60 shown in FIG. 7. However, other embodiments may include an aperture that is not generally cylindrical, such as embodiments in which the aperture is generally rectangular, generally triangular, generally hexagonal, or the like. By forming the aperture 730 through a portion of a thickness of the connector 700, as depicted in FIG. 7, the connector 700 may be more easily and less expensively manufactured than a connector including an aperture for receiving a grounding wire that is formed through a lug or protrusion axially protruding from the connector 700.

Still referring to FIG. 7, the securing port 740 extends through the connector 700 along a securing port centerline 745 and intersects the aperture 730. The securing port 740 is adapted to receive a securing member 70. The securing port 740 is internally threaded such that the securing port 740 is adapted to receive a threaded securing member 70 (e.g., a threaded grounding screw or set screw) that is selectively advanceable within the securing port 740 for securing the grounding wire 60 within the aperture 730. However, in other embodiments, the securing port 740 may not be internally threaded and the securing member 70 may not be a threaded grounding screw, such as embodiments in which the securing port 740 is not internally threaded and the securing member 70 is a press-fit pin, or the like. The securing port 740 is generally cylindrical, which may allow for the securing port 740 to securely and snugly receive a generally cylindrical securing member, such as a screw, pin, or the like. However, other embodiments may include a securing port that is not generally cylindrical, such as embodiments in which the securing port is generally rectangular, generally triangular, generally hexagonal, or the like.

As noted above, the aperture 730 extends through the connector 700 along the aperture centerline 735, and the securing port 740 extends through the connector 700 along the securing port centerline 745. In the embodiment depicted in FIG. 7, the aperture centerline 735 is offset from and parallel to the bore centerline 715. When the aperture 730 extends parallel to the bore centerline 715, the grounding wire 60 may extend parallel to the bore centerline 715 when the grounding wire 60 is secured to the connector 700 such that the grounding wire 60 does not interfere with access to the exterior gripping surface 724. However, it should be understood that in other embodiments the aperture centerline 735 may not be offset from and parallel to the bore centerline 715, such as embodiments in which the aperture 730 extends through the connector 700 at an angle offset from the bore centerline 715.

Still referring to FIG. 7, the securing port centerline 745 is transverse to the bore centerline 715 and is transverse to the aperture centerline 735. A securing port 740 having a securing port centerline 745 that is transverse to the aperture centerline 735 may allow for a securing member 70 to be inserted in the securing port 740 to snugly secure the grounding wire 60 within the aperture 730 with only minimal interference with access to the gripping portion 720. However, in other embodiments, the securing port centerline 745 may not be transverse to the bore centerline 715 and transverse to the aperture centerline 735 such as embodiments in which the securing port 740 extends through the connector 700 at an angle non-perpendicular to the aperture centerline 735.

Still referring to FIG. 7, the coupling portion 750 of the connector 700 is longitudinally offset from the gripping portion 720 and includes a threaded external surface for threadedly coupling the connector to another component, such as a hydraulic fitting or an RF connector having a corresponding internally threaded coupling portion.

Figure 8:
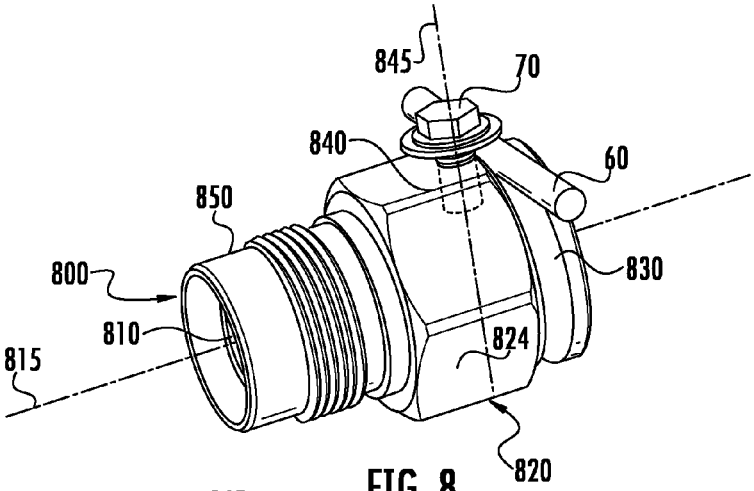
FIG. 8 schematically depicts a perspective view of a connector including an encircling annular grounding groove longitudinally adjacent to a gripping portion of the connector, according to one or more embodiments shown and described herein.

Referring now to FIG. 8, a connector 800 is depicted. The connector 800 is adapted to receive a conduit having an outer conductor and to ground the outer conductor of the conduit with a grounding wire. The connector 800 includes a bore 810, a gripping portion 820, a grounding groove 830, a securing port 840, and a coupling portion 850. The bore 810 extends longitudinally along a bore centerline 815 and is adapted to receive the conduit.

The gripping portion 820 axially surrounds the bore 810 and extends longitudinally along a length along the bore centerline 815. As with the connector 100 and the connector 700 described above, the gripping portion 820 is defined along the length between an interior bore-defining surface and an exterior gripping surface 824. The exterior gripping surface 824 may facilitate gripping of the connector 800 by a tool or a user's hand to manipulate or grip the connector such as when the exterior gripping surface 824 is engaged by a wrench to rotate or secure the connector 800 when coupling the connector 800 to another component. The exterior gripping surface 824 includes a plurality of external features extending around the exterior gripping surface. In the embodiment depicted in FIG. 8, the external features are six regular and repeated planar surfaces forming a hexagonal gripping surface, which may facilitate the gripping of the exterior gripping surface 824 by a tool (e.g., a wrench) or user's hand for manipulation of the connector 800. While the external features are planar surfaces in FIG. 8, other embodiments may include knurls as the external features. While the external surfaces of FIG. 8 are regular and repeated, in other embodiments, the external surfaces may not be regular or repeated, such as in embodiments in which the external features are not symmetric around the exterior gripping surface 824. In some embodiments, the exterior gripping surface 824 does not include a plurality of external features, such as when the exterior gripping surface 824 is a generally smooth cylinder.

As with the exterior gripping surface 124 of the connector 100 depicted and described above with respect to FIG. 2B, the exterior gripping surface 824 of the connector 800 (in a cross-section of the exterior gripping surface 824 taken perpendicular to the bore centerline at a location that does not intersect the securing port 840) is symmetric about a first plane parallel to the bore centerline 815 and is symmetric about a second plane parallel to the bore centerline 815 and perpendicular to the first plane. However, it should be understood that other embodiments may not include such a symmetric exterior gripping surface 824.

Still referring to FIG. 8, the grounding groove 830 is an encircling annular groove that encircles an outer diameter of the connector 800. However, in other embodiments the grounding groove 830 may only extend partially around the outer diameter of the connector 800. The grounding groove 830 is longitudinally adjacent to the gripping portion 820, though in other embodiments, the grounding groove 830 may be formed in the gripping portion 820, such as will be described below with reference to FIGS. 9-10. The grounding groove 830 extends transverse to the bore centerline 815 around the outer diameter of the connector 800, though in other embodiments the grounding groove 830 may have a spiral shape. The grounding groove 830 is adapted to receive the grounding wire 60 such that the grounding wire 60 extends transverse to the bore centerline 815 when the grounding groove 830 receives the grounding wire 60. When the grounding wire 60 is received by the grounding groove 830 such that the grounding wire 60 extends transverse to the bore centerline 815, multiple connectors 800 including such a transverse grounding groove 830 may be daisy chained together such that the connectors can be grounded by a common grounding wire received in each of the grounding grooves.

Still referring to FIG. 8, the securing port 840 extends through the exterior gripping surface 824 of the gripping portion 820. The securing port 840 is longitudinally offset from the grounding groove 830 and extends along a securing port centerline 845 that is transverse to the bore centerline 815. However, in some embodiments, the securing port 840 may not extend through the gripping portion 820, such as embodiments in which the securing port 840 extends through another portion of the connector 800 or embodiments that do not include the gripping portion 820. Furthermore, in some embodiments the securing port centerline 845 is not transverse to the bore centerline 815.

The securing port 840 is adapted to receive a securing member 70. The securing port 840 is internally threaded such that the securing port 840 is adapted to receive a threaded securing member 70 (e.g., a threaded grounding screw or set screw) that is selectively advanceable within the securing port 840 for securing the grounding wire 60 within the grounding groove 830. However, in other embodiments, the securing port 840 may not be internally threaded and the securing member 70 may not be a threaded grounding screw, such as embodiments in which the securing port 840 is not internally threaded and the securing member 70 is a press-fit pin, or the like. The securing port 840 is generally cylindrical, which may allow for the securing port 840 to securely and snugly receive a generally cylindrical securing member, such as a screw, pin, or the like. However, other embodiments may include a securing port that is not generally cylindrical, such as embodiments in which the securing port is generally rectangular, generally triangular, generally hexagonal, or the like.

Still referring to FIG. 8, the coupling portion 850 of the connector 800 is longitudinally offset from the gripping portion 820 and includes a threaded external surface for threadedly coupling the connector to another component, such as a hydraulic fitting or an RF connector having a corresponding internally threaded coupling portion.

Figure 9:
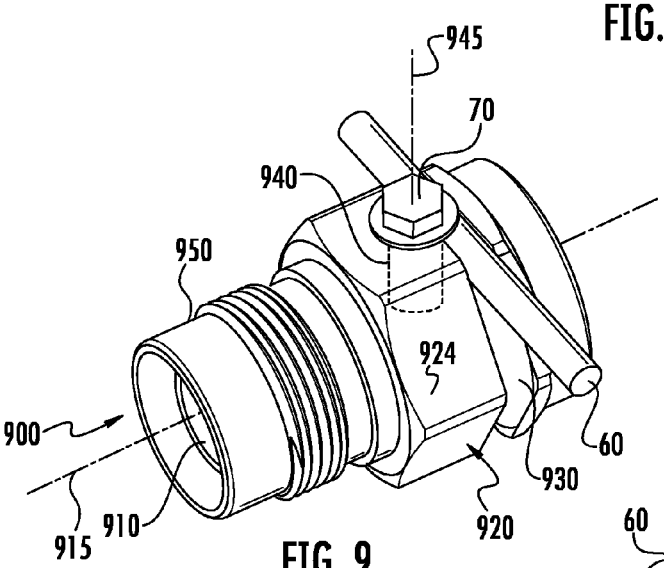
FIG. 9 schematically depicts a perspective view of a connector including an encircling annular grounding groove formed within a gripping portion of the connector, according to one or more embodiments shown and described herein.

Referring now to FIG. 9, a connector 900 is depicted. The connector 900 is adapted to receive a conduit having an outer conductor and to ground the outer conductor of the conduit with a grounding wire. The connector 900 includes a bore 910, a gripping portion 920, a grounding groove 930, a securing port 940, and a coupling portion 950. The bore 910 extends longitudinally along a bore centerline 915 and is adapted to receive the conduit.

The gripping portion 920 axially surrounds the bore 910 and extends longitudinally along a length along the bore centerline 915. The gripping portion 920 is defined along the length between an interior bore-defining surface and an exterior gripping surface 924. The exterior gripping surface 924 may facilitate gripping of the connector 900 by a tool or a user's hand to manipulate or grip the connector such as when the exterior gripping surface 924 is engaged by a wrench to rotate or secure the connector 900 when coupling the connector 900 to another component. The exterior gripping surface 924 includes a plurality of external features extending around the exterior gripping surface. In the embodiment depicted in FIG. 9, the external features are six regular and repeated planar surfaces forming a hexagonal gripping surface, which may facilitate the gripping of the exterior gripping surface 924 by a tool (e.g., a wrench) or user's hand for manipulation of the connector 900. While the external features are planar surfaces in FIG. 9, other embodiments may include knurls as the external features. While the external surfaces of FIG. 9 are regular and repeated, in other embodiments, the external surfaces may not be regular or repeated, such as in embodiments in which the external features are not symmetric around the exterior gripping surface 924. In some embodiments, the exterior gripping surface 924 does not include a plurality of external features, such as when the exterior gripping surface 924 is a generally smooth cylinder.

As with the exterior gripping surface 124 of the connector 100 depicted and described above with respect to FIG. 2B, the exterior gripping surface 924 of the connector 900 (in a cross-section of the exterior gripping surface 924 taken perpendicular to the bore centerline at a location that does not intersect the securing port 940 or the grounding groove 930) is symmetric about a first plane parallel to the bore centerline 915 and is symmetric about a second plane parallel to the bore centerline 915 and perpendicular to the first plane. However, it should be understood that other embodiments may not include such a symmetric exterior gripping surface 924.

Still referring to FIG. 9, the grounding groove 930 is formed through the exterior gripping surface 924. The grounding groove 930 is an encircling annular groove that encircles an outer diameter of the exterior gripping surface 924. However, in other embodiments the grounding groove 930 may only extend partially around the outer diameter of the exterior gripping surface 924. The grounding groove 930 extends transverse to the bore centerline 915 around the outer diameter of the connector 900, though in other embodiments the grounding groove 930 may not be transverse to the bore centerline 915. The grounding groove 930 is adapted to receive the grounding wire 60 such that the grounding wire 60 extends transverse to the bore centerline 915 when the grounding groove 930 receives the grounding wire 60. When the grounding wire 60 is received by the grounding groove 930 such that the grounding wire 60 extends transverse to the bore centerline 915, multiple connectors 900 including such a transverse grounding groove 930 may be daisy chained together such that the connectors can be grounded by a common grounding wire received in each of the grounding grooves.

Still referring to FIG. 9, the securing port 940 extends through the exterior gripping surface 924 of the gripping portion 920. The securing port 940 is longitudinally offset from the grounding groove 930 and extends along a securing port centerline 945 that is transverse to the bore centerline 915. However, in some embodiments, the securing port 940 may not extend through the gripping portion 920, such as embodiments in which the securing port 940 extends through another portion of the connector 900 or embodiments that do not include the gripping portion 920. Furthermore, in some embodiments the securing port centerline 945 is not transverse to the bore centerline 915.

The securing port 940 is adapted to receive a securing member 70. The securing port 940 is internally threaded such that the securing port 940 is adapted to receive a threaded securing member 70 (e.g., a threaded grounding screw or set screw) that is selectively advanceable within the securing port 940 for securing the grounding wire 60 within the grounding groove 930. However, in other embodiments, the securing port 940 may not be internally threaded and the securing member 70 may not be a threaded grounding screw, such as embodiments in which the securing port 940 is not internally threaded and the securing member 70 is a press-fit pin, or the like. The securing port 940 is generally cylindrical, which may allow for the securing port 940 to securely and snugly receive a generally cylindrical securing member, such as a screw, pin, or the like. However, other embodiments may include a securing port that is not generally cylindrical, such as embodiments in which the securing port is generally rectangular, generally triangular, generally hexagonal, or the like.

Still referring to FIG. 9, the coupling portion 950 of the connector 900 is longitudinally offset from the gripping portion 920 and includes a threaded external surface for threadedly coupling the connector to another component, such as a hydraulic fitting or an RF connector having a corresponding internally threaded coupling portion.

Figure 10:
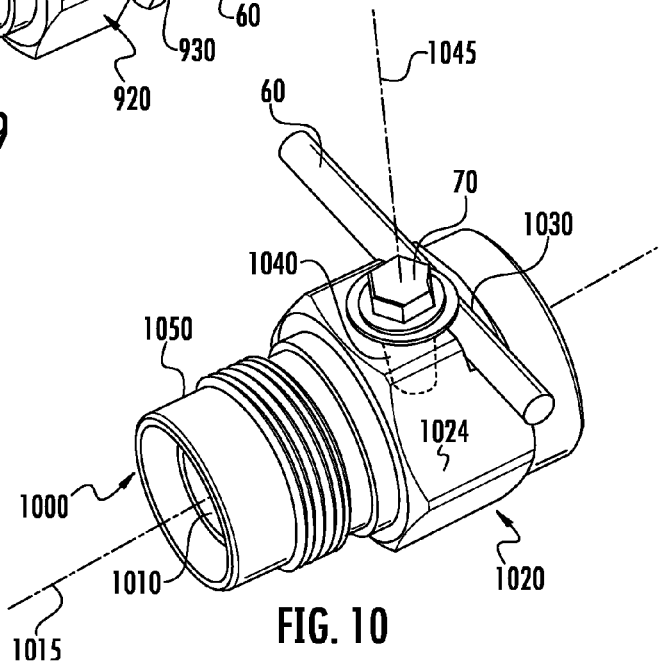
FIG. 10 schematically depicts a perspective view of a connector including a grounding groove formed within a gripping portion of the connector, according to one or more embodiment shown and described herein.

Referring now to FIG. 10, a connector 1000 is depicted. The connector 1000 is adapted to receive a conduit having an outer conductor and to ground the outer conductor of the conduit with a grounding wire. The connector 1000 includes a bore 1010, a gripping portion 1020, a grounding groove 1030, a securing port 1040, and a coupling portion 1050. The bore 1010 extends longitudinally along a bore centerline 1015 and is adapted to receive the conduit.

The gripping portion 1020 axially surrounds the bore 1010 and extends longitudinally along a length along the bore centerline 1015. The gripping portion 1020 is defined along the length between an interior bore-defining surface and an exterior gripping surface 1024. The exterior gripping surface 1024 may facilitate gripping of the connector 1000 by a tool or a user's hand to manipulate or grip the connector such as when the exterior gripping surface 1024 is engaged by a wrench to rotate or secure the connector 1000 when coupling the connector 1000 to another component. The exterior gripping surface 1024 includes a plurality of external features extending around the exterior gripping surface. In the embodiment depicted in FIG. 10, the external features are six regular and repeated planar surfaces forming a hexagonal gripping surface, which may facilitate the gripping of the exterior gripping surface 1024 by a tool (e.g., a wrench) or user's hand for manipulation of the connector 1000. While the external features are planar surfaces in FIG. 10, other embodiments may include knurls as the external features. While the external surfaces of FIG. 10 are regular and repeated, in other embodiments, the external surfaces may not be regular or repeated, such as in embodiments in which the external features are not symmetric around the exterior gripping surface 1024. In some embodiments, the exterior gripping surface 1024 does not include a plurality of external features, such as when the exterior gripping surface 1024 is a generally smooth cylinder.

As with the exterior gripping surface 124 of the connector 100 depicted and described above with respect to FIG. 2B, the exterior gripping surface 1024 of the connector 1000 (in a cross-section of the exterior gripping surface 1024 taken perpendicular to the bore centerline 1015 at location that does not intersect the securing port 1040 or the grounding groove 1030) is symmetric about a first plane parallel to the bore centerline 1015 and is symmetric about a second plane parallel to the bore centerline 1015 and perpendicular to the first plane. However, it should be understood that other embodiments may not include such a symmetric exterior gripping surface 1024.

Still referring to FIG. 10, the grounding groove 1030 is formed through the exterior gripping surface 1024. The grounding groove 1030 extends along a portion of the exterior gripping surface 1024 transverse to the bore centerline 1015 around the outer diameter of the connector 1000. In some embodiments, the grounding groove 1030 may not be transverse to the bore centerline 1015. The grounding groove 1030 is adapted to receive the grounding wire 60 such that the grounding wire 60 extends transverse to the bore centerline 1015 when the grounding groove 1030 receives the grounding wire 60. When the grounding wire 60 is received by the grounding groove 1030 such that the grounding wire 60 extends transverse to the bore centerline 1015, multiple connectors 1000 including such a transverse grounding groove 1030 may be daisy chained together such that the connectors can be grounded by a common grounding wire received in each of the grounding grooves.

Still referring to FIG. 10, the securing port 1040 extends through the exterior gripping surface 1024 of the gripping portion 1020. The securing port 1040 is longitudinally offset from the grounding groove 1030 and extends along a securing port centerline 1045 that is transverse to the bore centerline 1015. However, in some embodiments, the securing port 1040 may not extend through the gripping portion 1020, such as embodiments in which the securing port 1040 extends through another portion of the connector 1000 or embodiments that do not include the gripping portion 1020. Furthermore, in some embodiments the securing port centerline 1045 is not transverse to the bore centerline 1015.

The securing port 1040 is adapted to receive a securing member 70. The securing port 1040 is internally threaded such that the securing port 1040 is adapted to receive a threaded securing member 70 (e.g., a threaded grounding screw or set screw) that is selectively advanceable within the securing port 1040 for securing the grounding wire 60 within the grounding groove 1030. However, in other embodiments, the securing port 1040 may not be internally threaded and the securing member 70 may not be a threaded grounding screw, such as embodiments in which the securing port 1040 is not internally threaded and the securing member 70 is a press-fit pin, or the like. The securing port 1040 is generally cylindrical, which may allow for the securing port 1040 to securely and snugly receive a generally cylindrical securing member, such as a screw, pin, or the like. However, other embodiments may include a securing port that is not generally cylindrical, such as embodiments in which the securing port is generally rectangular, generally triangular, generally hexagonal, or the like.

Still referring to FIG. 10, the coupling portion 1050 of the connector 1000 is longitudinally offset from the gripping portion 1020 and includes a threaded external surface for threadedly coupling the connector to another component, such as a hydraulic fitting or an RF connector having a corresponding internally threaded coupling portion.

Figure 11:
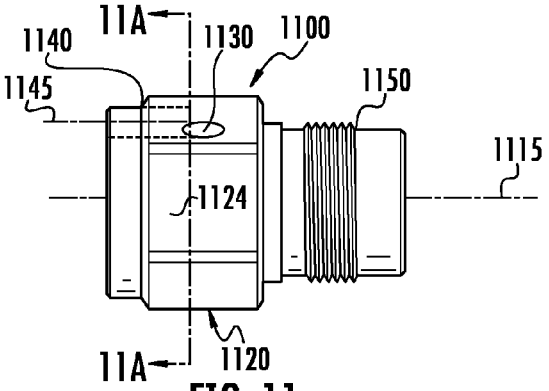
FIG. 11 schematically depicts a side view of a connector including a first aperture portion and a second aperture portion extending through a gripping portion of the connector, according to one or more embodiments shown and described herein.
Figure 11A:
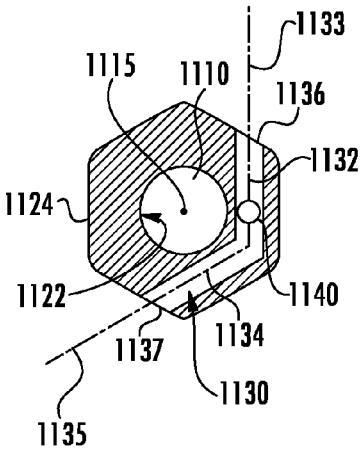
FIG. 11A schematically depicts a cross sectional view of the connector of FIG. 11 taken along the 11A-11A line of FIG. 11, according to one or more embodiments shown and described herein.
Figure 11B:
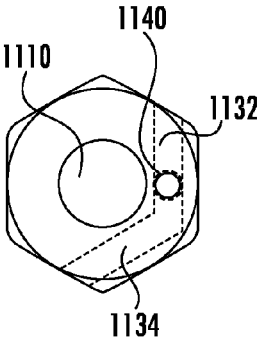
FIG. 11B schematically depicts a top view of the connector of FIG. 11, according to one or more embodiments shown and described herein.

Referring now to FIGS. 11, 11A, and 11B, a connector 1100 is schematically depicted. The connector 1100 is adapted to receive a conduit having an outer conductor and to ground the outer conductor of the conduit with a grounding wire. The connector 1100 includes a bore 1110, a gripping portion 1120, an aperture 1130, a securing port 1140, and a coupling portion 1150. The bore 1110 extends longitudinally along a bore centerline 1115 and is adapted to receive the conduit.

The gripping portion 1120 axially surrounds the bore 1110 and extends longitudinally along a length along the bore centerline 1115. The gripping portion 1120 is defined between an interior bore-defining surface 1122 and an exterior gripping surface 1124. The exterior gripping surface 1124 may facilitate gripping of the connector 1100 by a tool or a user's hand to manipulate or grip the connector such as when the exterior gripping surface 1124 is engaged by a wrench to rotate or secure the connector 1100 when coupling the connector 1100 to another component. The exterior gripping surface 1124 includes a plurality of external features extending around the exterior gripping surface. In the embodiment depicted in FIG. 11, the external features are six regular and repeated planar surfaces forming a hexagonal gripping surface, which may facilitate the gripping of the exterior gripping surface 1124 by a tool (e.g., a wrench) or user's hand for manipulation of the connector 1100. While the external features of FIG. 11 are planar surfaces, other embodiments may include knurls as the external features. While the external surfaces of FIG. 11 are regular and repeated, in other embodiments, the external surfaces may not be regular or repeated, such as in embodiments in which the external features are not symmetric around the exterior gripping surface 1124. In some embodiments, the exterior gripping surface 1124 does not include a plurality of external features, such as when the exterior gripping surface 1124 is a generally smooth cylinder.

As with the exterior gripping surface 124 of the connector 100 depicted and described above with respect to FIG. 2B, the exterior gripping surface 1124 of the connector 1100 (in a cross-section of the exterior gripping surface 1124 taken perpendicular to the bore centerline at location that does not intersect the aperture 1130 or the securing port 1140) is symmetric about a first plane parallel to the bore centerline 1115 and is symmetric about a second plane parallel to the bore centerline 1115 and perpendicular to the first plane. However, it should be understood that other embodiments may not include such a symmetric exterior gripping surface 1124

Referring to FIG. 11, the aperture 1130 is adapted to receive a grounding wire for grounding the connector 1100. Referring to FIG. 11A, the aperture 1130 extends through the gripping portion 1120 from a generally circular entry location 1136 to a generally circular exit location 1137. The aperture 1130 includes a first aperture portion 1132 and a second aperture portion 1134 that intersects the first aperture portion 1132. Each of the first aperture portion 1132 and the second aperture portion 1134 are adapted to receive the grounding wire therethrough. The first aperture portion 1132 extends through the gripping portion 1120 along a first aperture centerline 1133. The second aperture portion 1134 extends through the gripping portion 1120 along a second aperture centerline 1135. The first aperture centerline 1133 intersects the second aperture centerline 1135 such that the first aperture portion 1132 and the second aperture portion 1134 are not co-linear. The first aperture centerline 1133 is transverse to the bore centerline 1115. The second aperture centerline 1135 is transverse to the bore centerline 1115. When the first aperture portion 1132 and the second aperture portion 1134 extend transverse to the bore centerline 1115, multiple connectors 1100 may be daisy chained together such that the connectors can be grounded by a common grounding wire received in each of the apertures. However, it should be understood that in other embodiments one or more of the first aperture portion 1132 and the second aperture portion 1134 may not extend transverse to the bore centerline 1115.

The aperture 1130 is generally cylindrical, which may allow for the aperture 1130 to securely and snugly receive a generally cylindrical grounding wire. However, other embodiments may include an aperture that is not generally cylindrical, such as embodiments in which the aperture is generally rectangular, generally triangular, generally hexagonal, or the like. In embodiments in which the aperture is not generally cylindrical, the entry location 1136 and the exit location 1137 may not be generally circular, but may be of corresponding shape to the aperture. While the aperture 1130 extends through a thickness of the gripping portion 1120, in other embodiments, the aperture 1130 may extend through a thickness of another portion of the connector 1100, such as in embodiments in which the aperture 1130 extends through a portion of the connector 1100 that is longitudinally adjacent to or offset from the gripping portion 1120 or in embodiments that do not include the gripping portion 1120.

By forming the aperture 1130 through a thickness of the gripping portion 1120, the connector 1100 may be more easily and less expensively manufactured than a connector including an aperture for receiving a grounding wire that is formed through a lug or protrusion axially protruding from the connector 1100.

The securing port 1140 extends through the connector 1100 along a securing port centerline 1145 and intersects the aperture 1130. The securing port 1140 is adapted to receive a securing member for securing the grounding wire within the aperture 1130. The securing port centerline 1145 is offset from and parallel to the bore centerline 1115. However, in other embodiments, the securing port centerline 1145 may not be parallel to the bore centerline 1115.

The coupling portion 1150 of the connector 1100 is longitudinally offset from the gripping portion 1120 and includes a threaded external surface for threadedly coupling the connector to a component. In some embodiments, the connector 1100 may be threadedly coupled to a hydraulic fitting through which hydraulic fluid may be introduced into the bore of the connector 1100.

The connectors described herein may be formed from any conductive material. For example, in some embodiments, the connectors described herein may be formed from aluminum or brass.

It should now be understood that embodiments described herein are directed to connectors adapted to receive conduits having an outer conductor and for grounding the outer conductor via a grounding wire secured to the connector in an aperture or grounding groove of the connector. Connectors including apertures adapted to receive grounding wires that extend through a thickness of the connector defined between a symmetric external surface and an interior bore-defining surface, as described herein, may be more easily and less expensively manufactured. Furthermore, connectors that include grounding wire receiving apertures that extend transverse to a bore centerline of the connector may facilitate the daisy chaining of multiple connectors to be grounded by a common grounding wire. Connectors that include grounding wire receiving through apertures may similarly facilitate the daisy chaining of multiple connectors, as described above. Finally, connectors including grounding grooves formed through an external surface of the connector may also provide an easy and convenient way to ground a conduit electrically coupled to the connector via a grounding wire in engagement with the grounding groove. The connectors described herein may be more compact, require fewer parts, and require less mounting space than conventional grounding connectors.

For the purposes of describing and defining the subject matter of the disclosure it is noted that the term "substantially" is utilized herein to represent the inherent degree of uncertainty that may be attributed to any quantitative comparison, value, measurement, or other representation.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A connector adapted to receive a conduit having an outer conductor and for grounding the outer conductor of the conduit with a grounding wire, the connector comprising:

a bore extending longitudinally along a bore centerline and adapted to receive the conduit;

an annular grounding groove extending at least partially around an outer diameter of the connector and encircling the outer diameter of the connector, wherein the grounding groove is adapted to receive the grounding wire such that the grounding wire extends transverse to the bore centerline when the grounding groove receives the grounding wire; and a securing port longitudinally offset from the grounding groove and extending along a securing port centerline, wherein the securing port centerline is transverse to the bore centerline, and the securing port is adapted to receive a securing member for securing the grounding wire within the grounding groove.

2. The connector of claim 1, further comprising a gripping portion axially surrounding the bore and extending longitudinally along a length along the bore centerline, wherein the gripping portion is defined along the length between an interior bore-defining surface and an exterior gripping surface, wherein the grounding groove is longitudinally adjacent to the gripping portion.

3. The connector of claim 1, further comprising a gripping portion axially surrounding the bore and extending longitudinally along a length along the bore centerline, wherein the gripping portion is defined along the length between an interior bore-defining surface and an exterior gripping surface, wherein the grounding groove is formed through the exterior gripping surface.

4. The connector of claim 3, wherein the grounding groove is an encircling annular grounding groove.

5. The connector of claim 1, further comprising the securing member disposed within the securing port and selectively advanceable within the securing port for securing the grounding wire within the generally cylindrical through hole.

6. The connector of claim 1, wherein the securing member includes a break-away head.

7. The connector of claim 1, further comprising the grounding wire disposed within the generally cylindrical through hole and secured to the connector by the securing member.

* * * * *